US005778958A

United States Patent [19]

Stebner

[11] Patent Number: 5,778,958

[45] Date of Patent: Jul. 14, 1998

[54] WINDOW SHUTTER AND METHOD THEREFOR

[76] Inventor: Richard A. Stebner, 757 W. 37 St., Yuma, Ariz. 85365

[21] Appl. No.: 816,560

[22] Filed: Mar. 13, 1997

Related U.S. Application Data

[63] Continuation of Ser. No. 546,907, Oct. 23, 1995, abandoned.

[51] Int. Cl.[6] ..... E05D 15/00

[52] U.S. Cl. ..... 160/210; 160/187; 160/213; 52/309.9

[58] Field of Search ..... 160/107, 117, 160/187, 210, 213, 229, 236; 52/202, 309.9, 473, 522, 795, 869; 16/223, 362, 389

[56] References Cited

U.S. PATENT DOCUMENTS

| | | | |
|---|---|---|---|
| 3,191,242 | 6/1965 | Rauen | 52/473 |
| 3,584,427 | 6/1971 | Johnston | 52/473 |
| 3,797,186 | 3/1974 | Smith | 52/473 X |
| 3,868,803 | 3/1975 | Bice | 52/473 |
| 3,886,703 | 6/1975 | Rousey | 52/473 |
| 4,442,827 | 4/1984 | Helman et al. | 52/522 X |
| 4,495,978 | 1/1985 | Carroll | 160/213 X |
| 4,610,291 | 9/1986 | Carroll | 160/213 X |
| 4,663,904 | 5/1987 | Glenn | 52/202 |
| 4,833,896 | 5/1989 | Carlson | 62/304 |
| 5,163,493 | 11/1992 | Kraeutler | 160/236 X |
| 5,347,782 | 9/1994 | Vagedes | 52/473 |
| 5,375,641 | 12/1994 | Schleuter | 160/135 |
| 5,622,012 | 4/1997 | Schijf | 52/309.9 |

*Primary Examiner*—Daniel P. Stodola
*Assistant Examiner*—Bruce A. Lev
*Attorney, Agent, or Firm*—Harry M. Weiss; Jeffrey D. Moy; Harry M. Weiss & Associates, P.C.

[57] ABSTRACT

An insulating window shutter comprised of a one-piece, molded window shutter and hinge for coupling two window shutters together and for coupling a window shutter to a window jam. In the preferred embodiment, the window shutter is made from an expanded foam plastic such as Styrofoam®, and the interior and exterior faces of the window shutter comprise a plurality of simulated wooden slats in the closed position.

8 Claims, 2 Drawing Sheets

WINDOW SHUTTER AND METHOD THEREFOR

This is a continuation of application Ser. No. 08/546,907 filed on Oct. 23, 1995, now abandoned.

BACKGROUND OF THE INVENTION

1. Field of Invention

This invention relates generally to indoor window shutters and methods therefor and, more particularly, to an insulating window shutter and method wherein the shutter is made of cast or expanded foam plastic that is formed to look like a wooden window shutter with the slats in the closed position, which shutter conserves radiant energy inside the house and blocks radiant energy from entering through the window from outside of the house.

2. Background of the Invention

Window shutters serve both decorative and useful purposes. Window treatments, including window shutters, are often used to improve the appearance of the interior and exterior of a house. One common window treatment is a wooden shutter, which typically incorporates a row or rows of horizontal wooden slats that are joined by a bar that is perpendicular to the slats. Each individual wooden shutter can be opened, by manipulating the horizontal wooden slats so as to position an edge portion of each shutter perpendicular to the adjacent window to allow exterior light to enter the interior of the house. In the closed position, the elongated front (or back, if desired) surface area of each individual horizontal wooden slat is in a position that is substantially parallel to the adjacent window.

A wooden window shutter in the closed position will prevent a significant portion of the exterior light from passing through the particular window. However, because of the limited insulating properties of the relatively thin wood that is used and the plurality of small sized gaps between the individual slats, a closed wooden shutter is only minimally effective in blocking incoming radiant energy where desired (e.g., in the summer months), or in keeping radiant and convection heat from escaping the interior of a home where necessary (e.g., in the winter months).

The prior art in this area contains several examples of interior window shutters with increased insulating efficiency over wooden shutters. For example, U.S. Pat. No. 4,363,351 issued to Eriksen discloses a thermal insulating shutter assembly, wherein the shutter assembly is constructed using panel members and top, bottom, and side members, so as to create an enclosed interior chamber, which interior chamber appears to provide some degree of thermal insulation.

U.S. Pat. No. 4,620,581 issued to Wallace discloses an insulation and security shutter. The shutter in Wallace, like that in Eriksen, incorporates a sandwich design, wherein two side panels and top, bottom, and side containment pieces surround insulating material to create the shutter's purported insulating properties.

U.S. Pat. No. 4,454,691 issued to Mitchell also discloses an apparatus for insulating windows. The apparatus in Mitchell is a thermal shutter consisting of a panel adhered to frame members surrounding the periphery of the panel, a rail for mounting the shutter to the window opening, and a coupling for connecting the shutter to the rail.

While each of the above-noted prior art shutters purports to have improved insulating properties in comparison to traditional shutters, there are drawbacks to these prior art designs. Each of these designs features a frame—consisting of bottom, side and top elements in Wallace and Eriksen and frame members in Mitchell—surrounding an insulated panel. Because none of the prior art shutters are one-piece designs, the construction of those shutters involves multiple fabrication steps, including cutting, gluing, extruding, molding, and also intricate alignment procedures. The construction of the prior art shutters also requires the use of a variety of tools, including saws and miters, and requires the use of a number of different kinds of materials, including wood, fiberglass, foam plastics and metal. Moreover, the prior art shutters lack the attractiveness of traditional wooden shutters—Wallace attempts to solve this problem by providing for the addition of extra panels to the insulating shutter, which addition only increases the complexity, cost, and weight of the Wallace shutter.

Therefore, a need existed to provide an improved window shutter with increased insulating efficiency, while maintaining the attractiveness of traditional wooden shutters. The improved insulating shutter and method must also utilize a lightweight, one-piece design, thereby simplifying the construction process and reducing the cost of the shutter and its weight—thereby preventing the "drooping" of the shutter. The improved shutter must also be hinged, so that one panel can be joined to another and/or to a window frame to form a window system. Finally, the improved shutter must be attractive—by being made similar in appearance to traditional wooden shutters and/or by being capable of being painted—so that a user will not be required to sacrifice appearance in order to obtain a shutter with improved insulating qualities.

SUMMARY OF THE INVENTION

In accordance with one embodiment of the present invention, it is an object of the present invention to provide an improved insulating window shutter and method therefor.

It is another object of the present invention to provide an insulating window shutter and method therefor wherein each individual shutter, excluding hinges, consists of one piece.

It is a still further object of the present invention to provide an insulating window shutter and method therefor which is lightweight.

It is still another object of the present invention to provide an insulating window shutter and method therefor which is capable of blocking incoming radiant energy and keeping radiant and convection heat from escaping the interior of a home.

BRIEF DESCRIPTION OF THE PREFERRED EMBODIMENTS

In accordance with one embodiment of the present invention, an insulating window shutter is disclosed. The insulating window shutter is constructed from an expandable foam plastic such as Styrofoam®, and is comprised of interior and exterior facades that are molded to resemble a traditional wooden shutter with the wooden slats in the closed position. The insulating shutter of this invention also includes hinging means for rotatably attaching two window shutters together or for rotatably attaching one window shutter to a window jam.

In accordance with another embodiment of the present invention, a method for providing an insulating window shutter is disclosed. The method comprises the steps of: providing an insulating window shutter constructed from an expandable foam plastic such as Styrofoam®, providing interior and exterior facades that are molded to resemble a traditional wooden shutter with the wooden slats in the closed position, and providing hinging means for rotatably attaching two window shutters together or for rotatably attaching one window shutter to a window jam.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
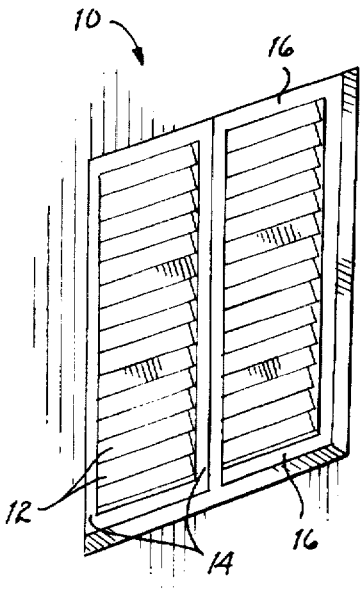
FIG. 1 is a perspective view of the insulating window shutter of the present invention, as installed in a window.
Figure 2:
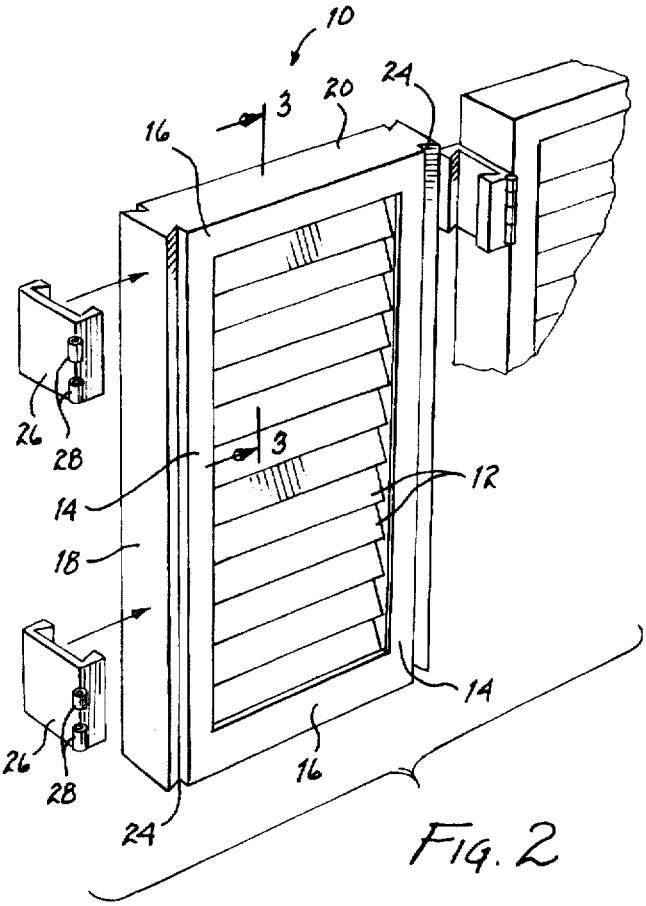
FIG. 2 is a perspective view of the insulating window shutter of the present invention, prior to installation in a window.

Referring to the embodiment of FIGS. 1 and 2, reference FIG. 10 refers generally to the insulating window shutter of this invention. One facade of insulating window shutter 10 is shown, in this embodiment, as containing a plurality of simulated wooden slats 12, surrounded on the left and right side by borders 14 and on the top and bottom by borders 16. The obverse facade to that shown in FIGS. 1 and 2 is identical. In this embodiment, the insulating window shutter has sides 18, a top 20, and a bottom 22 (not shown). In the spaces between the borders 14 and the sides 18 there are grooves 24, which may receive one or more brackets 26. The brackets 26 have one or more open-ended receptacles 28, which receptacles are positioned so that the receptacles on a second bracket 26 interlock with the receptacles on the first bracket, so that a rod 30 may be inserted through all of the joined receptacles 28 (see FIG. 7).

Figure 3:
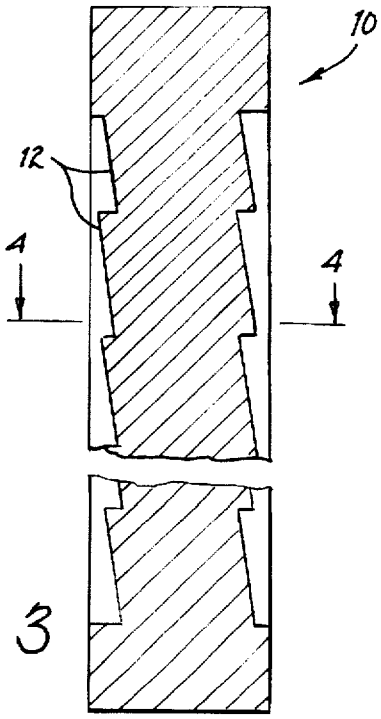
FIG. 3 is a cross-sectional view of the insulating window shutter of FIG. 2 taken along line 3—3.

Referring to FIG. 3, a cross-sectional view of the side of the insulated window shutter 10 of FIG. 2 is shown. In this figure, the insulating window shutter 10 is shown with a plurality of simulated wooden slats 12.

Figure 4:
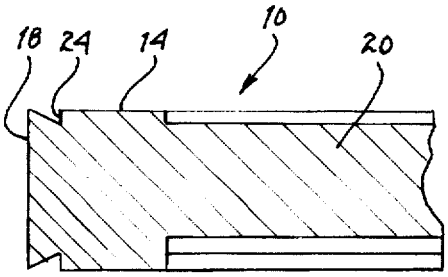
FIG. 4 is a cross-sectional view of the insulating window shutter of FIG. 3 taken along line 4—4.

Referring to FIG. 4, a cross-sectional view of the insulated window shutter 10 of FIG. 2 is shown, looking from the top 20 of the window shutter 10 to the bottom. In this figure, the grooves 24 are shown between the borders 14 and the sides 18, so as to receive one or more brackets 26 (not shown).

Figure 5:
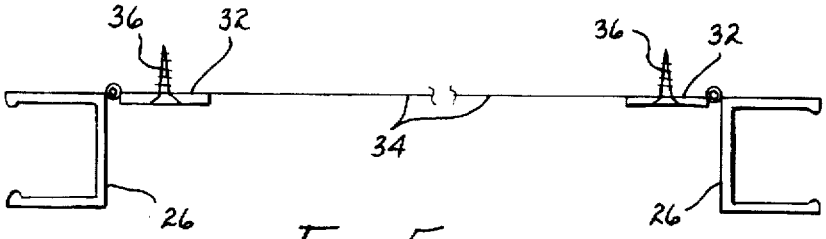
FIG. 5 is a top view of the hinges of the insulating window shutter of FIG. 2.
Figure 6:
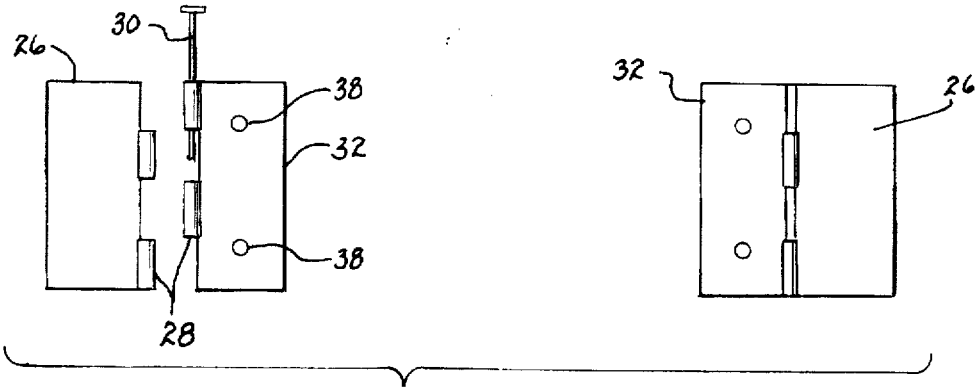
FIG. 6 is a front view of the hinges of the insulating shutter of FIG. 2.

Referring to FIG. 5, a top view of two brackets 26 is shown, wherein each bracket 26 interlocks with a plate 32 for attachment to a window jam 34 with one or more screws 36. Referring to FIG. 6, a front view of the two brackets 26 of FIG. 5 is shown, where each bracket 26 has a plurality of open-ended receptacles 28, which receptacles 28 interlock with corresponding receptacles 28 on a plate 32, and through which interlocked receptacles 28 a rod 30 is inserted. After insertion of the rod 30, the window shutter may be rotated along an axis defined by rod 30. In this embodiment, the plates 32 each have two openings 38 to receive screws 36 for insertion into a window jam 34, as shown in FIG. 5.

Figure 7:
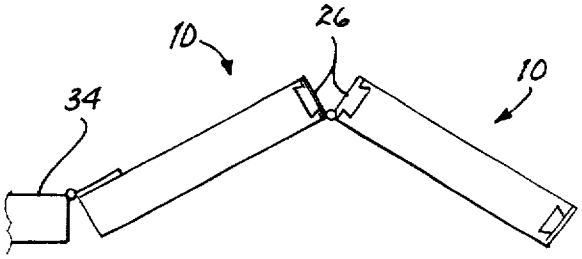
FIG. 7 is a top view of the insulating window shutter of FIG. 2 in a partially-opened position.
Figure 8:
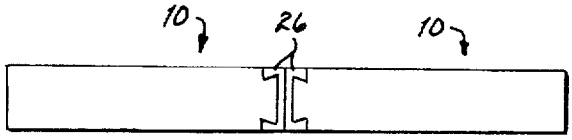
FIG. 8 is a top view of the insulating window shutter of FIG. 2 in a closed position.

Referring to FIGS. 7 and 8, a top view of the insulating window shutter 10 is shown, wherein two window shutters 10 are joined by interlocking brackets 26. Referring to FIG. 7, the two window shutters 10 are joined to a window jam 34, and are in a partially opened position relative to the window jam 34, and are in an angled position relative to one another. Referring to FIG. 8, the two window shutters 10 are in a straight position relative to one another.

While the invention has been particularly shown and described with reference to preferred embodiments thereof, it will be understood by those skilled in the art that the foregoing and other changes in form and details may be made therein without departing from the spirit and scope of the invention.

I claim:

1. An insulating window panel comprising, in combination:

a one-piece, substantially solid molded window panel comprising a plastic insulating material;

said one-piece, substantially solid molded window panel comprising:

an interior face comprising a plurality of simulated wooden slats in a closed position;

a first border region circumscribing said interior face;

an exterior face comprising a plurality of simulated wooden slats in a closed position;

an area between an inner surface of said interior face and an outer surface of said exterior face is substantially filled with an insulating material;

a second border region circumscribing said exterior face; and an area between an inner surface of said first border region and an outer surface of said second border region is substantially filled with an insulating material; and hinging means for connecting said window panel to at least one of a second window panel and a window jam comprising substantially v-shaped grooves located substantially at the convergence of said first border region, said second border region, and a side face extending perpendicularly from each of said first border region and said second border region so as to join said first border region and said second border region of said window panel; brackets with grasping means for attaching said brackets to said substantially v-shaped grooves; and coupling means attached to said brackets for coupling said brackets to one another.

2. An insulating window panel in accordance with claim 1, wherein said window panel is made of an expanded foam type plastic.

3. An insulating window panel in accordance with claim 1, where said coupling means comprises interlocking and open-ended receptacle means for receiving a rod.

4. An insulating window panel in accordance with claim 1, wherein said plastic insulating material of said window panel is painted having a simulated wood appearance.

5. A method for providing an insulating window panel, comprising the steps of:

providing a one-piece, substantially solid molded window panel comprising a plastic insulating material;

said one-piece, substantially solid molded window panel comprising:

an interior face comprising a plurality of simulated wooden slats in a closed position;

a first border region circumscribing said interior face;

an exterior face comprising a plurality of simulated wooden slats in a closed position;

an area between an inner surface of said interior face and an outer surface of said exterior face is substantially filled with an insulating material;

a second border region circumscribing said exterior face; and an area between an inner surface of said first border region and an outer surface of said second border region is substantially filled with an insulating material; and providing hinging means for connecting said window panel to at least one of a second window panel and a window jam comprising substantially v-shaped grooves located substantially at the convergence of said first border region, said second border region, and a side face extending perpendicularly from each of said first border region and said second border region so as to join said first border region and said second border region of said window panel; brackets with grasping means for attaching said brackets to said substantially v-shaped grooves; and coupling means attached to said brackets for coupling said brackets to one another.

6. The method of claim 5 further comprising the step of providing a window panel made of an expanded foam type plastic.

7. The method of claim 5 wherein said step of providing coupling means further comprises the step of providing interlocking and open-ended receptacle means for receiving a rod.

8. The method of claim 5 further comprising the step of painting said plastic insulating material of said window panel so as to provide such panel a simulated wood appearance.

* * * * *